US006321942B1

(12) United States Patent
Krampen et al.

(10) Patent No.: US 6,321,942 B1
(45) Date of Patent: Nov. 27, 2001

(54) DISCHARGE DEVICE FOR FLOWABLE MEDIA USING A THRUST PISTON PUMP

(75) Inventors: Gerald Krampen; Karl-Heinz Fuchs, both of Radolfzell; Hans Merk, Gaienhofen, all of (DE)

(73) Assignee: Ing. Erich Pfeiffer GmbH, Radolfzell (DE)

( * ) Notice: Subject to any disclaimer, the term of this patent is extended or adjusted under 35 U.S.C. 154(b) by 0 days.

(21) Appl. No.: 09/341,336

(22) PCT Filed: Jan. 8, 1998

(86) PCT No.: PCT/EP98/00061

§ 371 Date: Aug. 10, 1999

§ 102(e) Date: Aug. 10, 1999

(87) PCT Pub. No.: WO98/30335

PCT Pub. Date: Jul. 16, 1998

(30) Foreign Application Priority Data

Jan. 9, 1997 (DE) ..... 197 00 437
Jun. 3, 1997 (DE) ..... 197 23 133

(51) Int. Cl.[7] ..... B67D 5/00

(52) U.S. Cl. ..... 222/82; 222/153.05; 222/319; 222/320; 222/386

(58) Field of Search ..... 222/80, 82, 153.05, 222/153.06, 319, 320, 386

(56) References Cited

U.S. PATENT DOCUMENTS 3,403,823 * 10/1968 O'Donnell ..... 222/153.05
3,845,763 11/1974 Cloyd ..... 128/218 DA
4,162,746 7/1979 Anderson et al. ..... 222/153
5,511,698 4/1996 Stolignac ..... 222/162
5,813,570 * 9/1998 Fuchs et al. ..... 222/82

FOREIGN PATENT DOCUMENTS 28 35 639 8/1979 (DE) .
40 27 671 A1 3/1992 (DE) .
96 16 359.9 12/1992 (DE) .
44 12 041 A1 10/1995 (DE) .
195 09 247 A1 12/1995 (DE) .
296 01 047 U1 7/1996 (DE) .
536 607 A1 11/1992 (EP) .
679 443 A1 3/1995 (EP) .
WO 92/04129 3/1992 (WO) .

* cited by examiner

*Primary Examiner*—Joseph A. Kaufman
(74) *Attorney, Agent, or Firm*—Quarles & Brady LLP

(57) ABSTRACT

A disposable atomizer for discharging successive partial discharge amounts as a spray has a base body (12), a projecting nose adapter (13) with a nozzle (14), actuating shoulders (35) where two fingers can rest, and an actuating part, containing an actuating sleeve (25) and a medium store (20), which can be pressed into the base body (12). A hollow needle (17) can penetrate the closure piston-stopper (21) of said medium store (20). A ring (28) is mounted on the actuating sleeve (25) by spokes (29) and predetermined breaking points (30), the ring (28) separating in response to typical actuating pressure when the actuator is used the first time. The spokes (29) strike a stop which thus limits the first partial discharge stroke. By rotating the actuating sleeve (25), the actuating part is moved into a starting position for a second partial discharge stroke, and when intermediate webs in the form of material bridges are broken out, the second partial discharge stroke can be executed.

28 Claims, 3 Drawing Sheets

DISCHARGE DEVICE FOR FLOWABLE MEDIA USING A THRUST PISTON PUMP

BACKGROUND OF THE INVENTION

Figure 1:
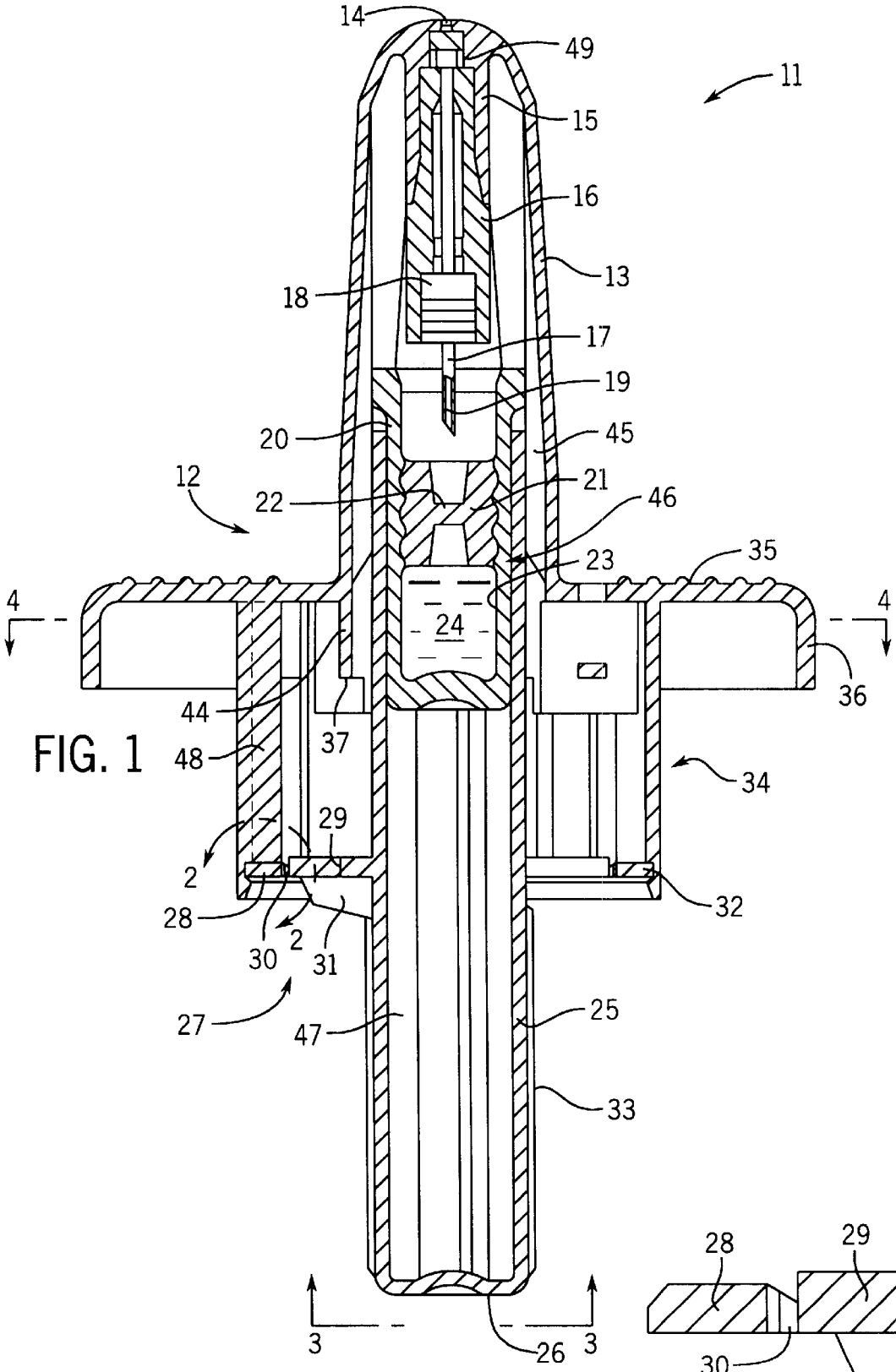

U.S. Pat. No. 4,964,069, assigned to the assignee herein, describes a discharge device in which a pump cylinder and a resilient stop constructed in the manner of a snap locking mechanism. Before a partial stroke can be effected, it is necessary for the operator to apply a specific actuating pressure, so that after overcoming this pressure threshold, a liquid is discharged with a specific minimum force and speed. This construction ensures that an adequate pressure exists at the outset for atomizing the medium, and that the pump is actuated up to the end of its stroke. Consequently, the complete content of the medium reservoir or store, which simultaneously forms the pump cylinder, is discharged in one or two strokes. Such single or multiple dosing devices are important for the delivery of medicaments, which are particularly critical with respect to the dosage, contamination, conservation or other criteria.

Published PCT application No. WO 92/00812, assigned to the assignee herein, discloses the use of medium reservoirs for a single discharge stroke, which are closed by a stopper simultaneously serving as a piston, the stopper being perforated by a needle for actuation purposes.

FR-A-1 535 293 discloses a tamper preventer for aerosol valves, in which predetermined breaking points are provided between the cap carrying the nozzle and a flange-like bead which can be snapped onto the container closure cover. These breaking points break prior to the first use.

EP-B-521 022 discloses a two-compartment atomizer, in which the stroke of a thrust piston pump is limited by a rocker on the circumference of the casing which is advanced for a second stroke.

DE-U-29 601 047 discloses a pump atomizer, which is designed for two successive discharge strokes. For this purpose on the sleeve receiving the medium container forming the pump cylinder there are two predetermined breaking rings, which come into successive engagement.

The second predetermined breaking ring forms a stop for ending the first discharge stroke step.

SUMMARY OF THE INVENTION

The present invention is provided in a discharge device for flowable media using a thrust piston pump and enabling discharge to take place in at least two successive discharge stroke steps. In particular, each of the discharge strokes take place with a predetermined minimum pressure and the component of the dispenser are preferably so secured against one another that the two discharges strokes cannot be performed with a single actuation even on applying high forces.

The invention provides two destructible pressure point protectors, each of which requires a predetermined actuating force for the release thereof.

Thus, it is possible to spray into both nostrils of the patient a medicament, which has to act rapidly, in two successive strokes. This is particularly important for medicaments for the treatment of highly painful illnesses or attacks thereof, such as migraine headaches. The medicaments which have been developed for treating such illnesses are very expensive and must therefore be used in a very accurately dosed manner. Their absorption by means of the nasal mucosus is very good and acts rapidly, but should be uniformly absorbed by both nostrils in order to further increase the rapid action. It must in particular be ensured that patients, suffering from a migraine attack, are frustrated by the pain and consequently a reliable, uncomplicated function of the discharge device is vital. This is ensured by the multi-stroke discharge device according to the invention, which overcomes any external circumstances.

The pressure point protector can contain at least one predetermined breaking point. In a particularly preferred manner, it is provided on a snap-in ring, which includes destructible material bridges on a sleeve receiving the medium container and forming an actuation pusher. This snap-in ring makes it possible to provide the material bridges on one of the two parts to be joined together so that following the separation of the material bridges, the ring which is snapped onto the other part will remain thereon.

When the first discharge stroke step has been initiated and the first stroke is ended, preferably a stop is provided, whose stop elements are, for example, spokes in the vicinity of the ring. Thus, when the first stroke is ended, the part movable with respect to the base body, i.e. the actuating sleeve with the medium store, strikes against a fixed stop, which ensures that simultaneously the second discharge stroke step is not initiated. For this purpose initially an unlocking actuation is carried out, for example, by mutually turning the two parts movable relative to one another. Thus, the spokes separated from the ring in the meantime and remaining on the actuating sleeve can be turned into a position where they are in the vicinity of webs, which are in turn connected to the base body by predetermined breaking points. This turning position can be limited by projecting wall portions, in order to prevent excessive turning. If now a second actuation takes place, once again the predetermined breaking points between the web and the base body break, so that a second discharge stroke is performed with a minimum actuating force being carried out.

It is important, particularly for pharmaceutical applications, that the medium store is hermetically sealed up to the time of the initial use. This can be brought about through a medium store, usually a cylindrical glass ampoule, which is closed by a plug of a rubbery material, which is perforated by a hollow needle during the first discharge stroke and which consequently forms a type of outlet or delivery valve. The discharge channel connected by it, or formed by it, remains open following the first stroke, so that atomization can immediately start during the following second stroke.

WO 93/00172 discloses in the case of a disposable atomizer having a different construction a smaller cross-section delivery tubule connected to a support section.

Particularly when applying a medicament to the nostrils, it is often important to direct the spray jet onto therapeutically, particularly favorable points. Thus, a further aim of the invention is to so construct an applicator that application is possible to specific points within body orifices, including particularly difficultly accessible points. To this end, a thin, long delivery or discharge tubule with a greatly reduced diameter, on whose end is located the outlet port, preferably in the form of a spray nozzle, can be connected to a connecting piece of the base body.

This makes it possible to introduce the delivery tubule into a nose channel, particularly the inner nostril, for the delivery of a medicament, preferably a vaccine or immunizing agent against common colds, such as influenza. It is admittedly known to apply pharmaceuticals to the nasal mucosus, so as to permit rapid absorption without burdening the gastrointestinal tract, but in the case of many medicaments, particularly the aforementioned vaccines against common colds, it is necessary or at least advantageous to apply them to specific nasal cavity areas, e.g. to the conchae nasi. The described delivery tubule shape permits the introduction into said area.

In order to permit an introduction of the delivery tubule into the corresponding curved areas of the nasal cavity, it can have a bend, such as a curve, a kink, etc. or can be angled away from the connecting piece. It can itself be elastically or plastically flexible, i.e. pliable, so that on introduction into a nose channel it adapts thereto.

In the case of a relatively long tubule, which due to the small diameter of generally below 5 mm. (preferably 2 to 4 mm) for a length of more than 10 mm (preferably 20 to 30 mm), cannot contain the actual applicator, i.e. usually a thrust piston pump, there is a problem of dead space, which not only impedes the flow of the normally very valuable medicament, but in particular impedes the spontaneity of pressure buildup by widening under pump pressure. This problem can be solved according to the invention in that the delivery tubule has an inner channel, which is largely filled by a filler, with the exception of a line channel for the medium. Its face adjacent to the discharge port can, together with the latter, form a boundary for spray nozzle vortex channels, which can be contained in said face in the form of spiral grooves.

In a preferred embodiment a disposable two-compartment atomizer for the delivery of two successive partial charges as a spray is created. It has on a base body a projecting nose adaptor with nozzle, actuating shoulders for the application of two fingers and an actuating part with an actuating sleeve which can be pressed into the base body and a medium store or reservoir held therein, whose closure piston stopper can be perforated by a hollow needle. A ring is fitted to the actuating sleeve is fitted by predetermined breaking points and spokes which, during a first actuation tear off, whilst maintaining a minimum actuating pressure. The spokes strike against a stop and consequently limit the first partial discharge stroke. By rotating the actuating sleeve the actuating portion is brought into the starting position for the second partial discharge stroke. There, intermediate webs inserted by material bridges are broken out, so that also the second partial stroke takes place, while maintaining a minimum actuating force.

These and further features can be gathered from the claims, description and drawings and the individual features, either singly or in the form of sub-combinations, can be implemented in an embodiment of the invention and in other fields and can represent advantageous, independently protectable constructions for which protection is hereby claimed. The subdivision of the application into individual sections and the subtitles in no way limit the general validity of the statements made thereunder.

BRIEF DESCRIPTION OF THE DRAWINGS n embodiment of the invention is described in greater detail hereinafter relative to the drawings, wherein show:

FIG. 1 A longitudinal section through a discharge device.

Figure 2:
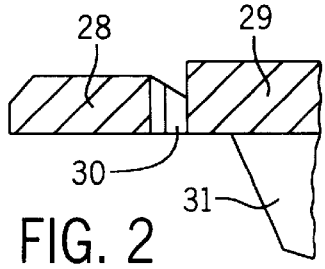

FIG. 2 A greatly enlarged detail of area II in FIG. 1.

Figure 3:
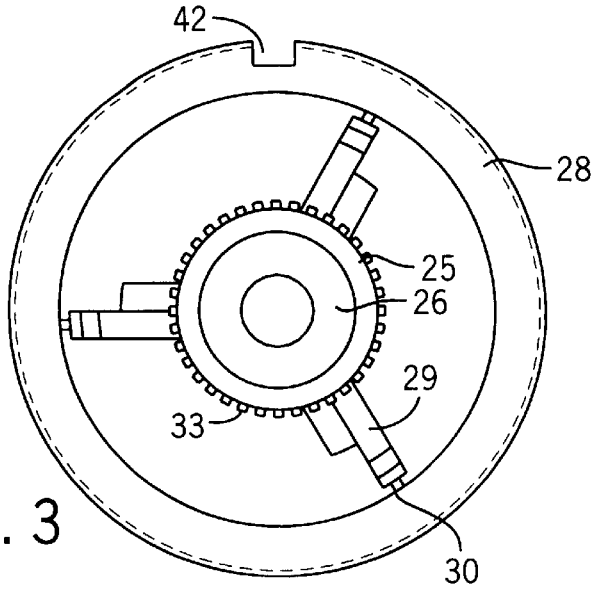

FIG. 3 A view of the actuating sleeve and shaped-on ring, shown from below following arrow III in FIG. 1.

Figure 4:
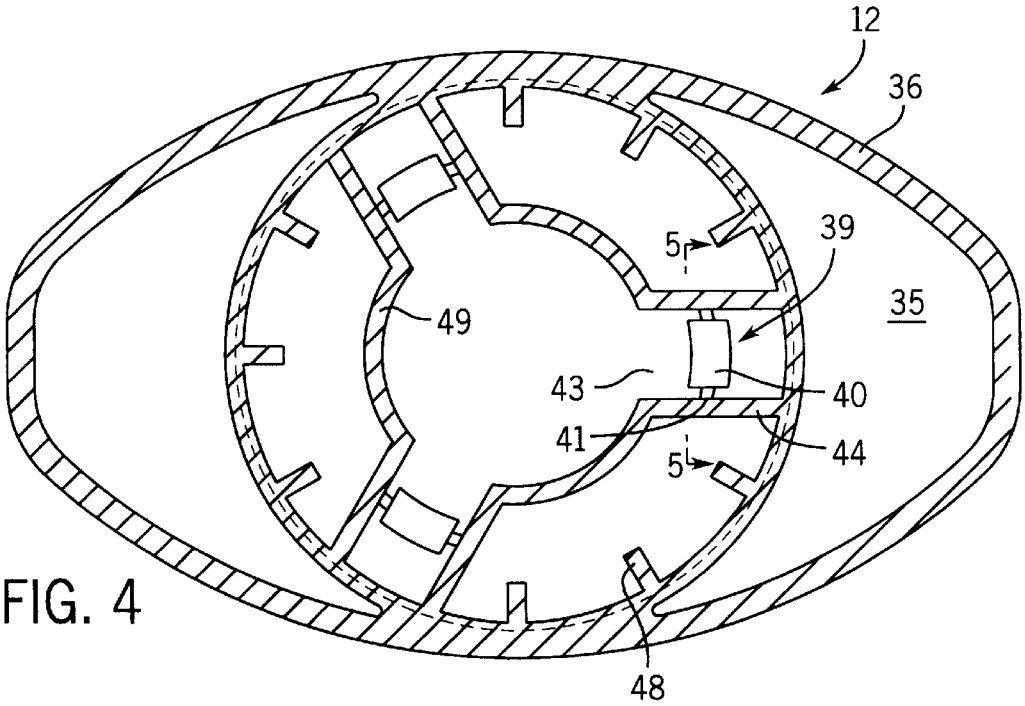

FIG. 4 A section along line IV in FIG. 1.

Figure 5:
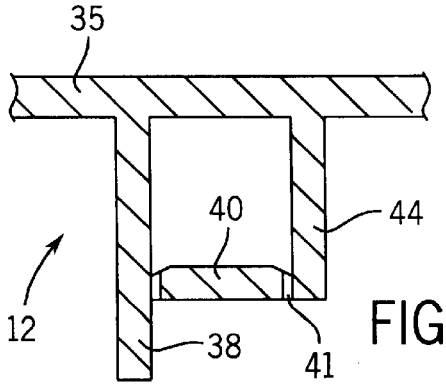

FIG. 5 A section along line V in, FIG. 4.

Figures 6, 7:
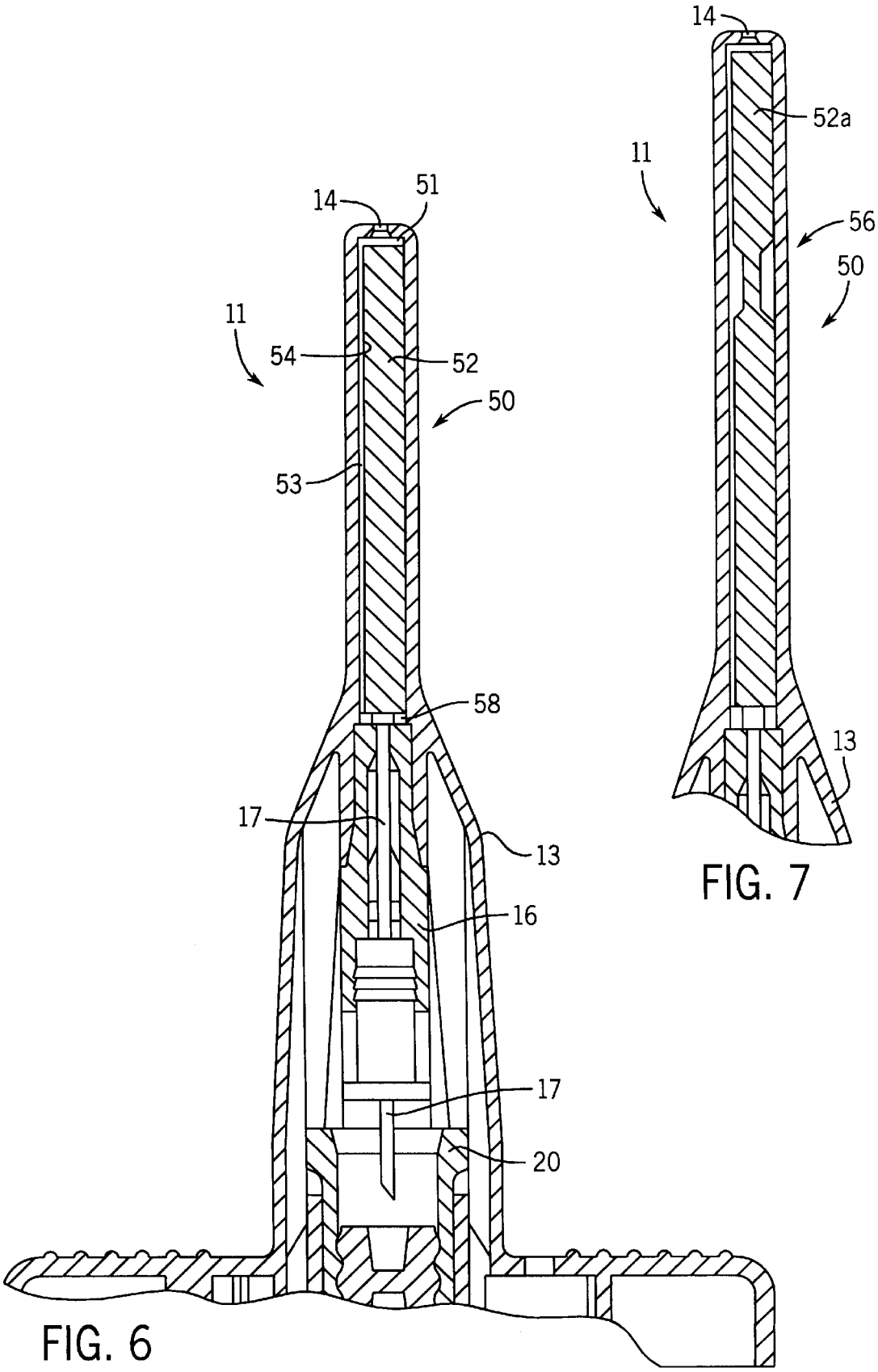

FIGS. 6 & 7 Partial longitudinal sections through variants of a discharge device.

DETAILED DESCRIPTION OF THE PREFERRED EMBODIMENTS

The discharge device 11 shown in the drawings has a base body 12 in the form of a plastic injection molding. It has a central, elongated connecting piece 13, whose shape and length is adapted to the particular application. In the present case it is a so-called nose adaptor intended to be introduced into the nostril of a patient. At its upper end it has a discharge opening 14 in the form of a spray nozzle with an upstream angle chamber and following onto the latter in the interior of the hollow connecting piece 13 is provided a sleeve-like piston rod carrier 15, into which is pressed from below a hollow piston rod 16. In the latter is pressed a plunger 17 in the form of a hollow steel needle chamfered at its lower, free end in similar manner to an injection or hypodermic needle, namely by a needle-surrounding seal 18. The needle-like plunger 17 completely penetrates the piston rod and is led up to the discharge opening 14 and consequently its interior forms a discharge channel 19.

The pharmaceutical medium 24 to be discharged is housed in a medium container 20, which is constructed as a cylindrical, downwardly closed and upwardly open, laterally flanged glass container similar to an ampoule. It simultaneously forms the medium reservoir or store and the pump chamber 23, so that its inner walls are simultaneously the cylinder path of a thrust piston pump 46. Its piston 21 is formed by a piston stopper, which is made from rubber or rubbery material and has in the center a diaphragm 22 in the form of a centrepiece with limited wall thickness, which can b e perforated by the plunger 17.

The medium container 20 is received in an actuating and reception sleeve 25, which is constructed in the form of a very long, downwardly closed plastic sleeve with inner reinforcing ribs for the medium container. Its closed bottom 26 forms an actuating surface for the discharge device 11. It is guided together with the medium container between ribs 45 in the interior of the connecting piece and is axially movable therein.

Onto the outer circumference is shaped a first pressure point protector 27. It comprises three connecting webs or spokes 29 (FIG. 3), which are connected by means of material bridges 30 to a circumferential, outer ring 28, which is received in a circumferential position with its outer circumference defined by a guide groove 42 in a snap connection 32, which is further provided on a cylindrical base portion 34 of the base body and namely on its lower border or edge. The material bridges are designed in such a way that they break on applying a predetermined actuating pressure (FIG. 2). An inner rib 48 of the base portion 34 secures the ring 28 in its axial position.

The base portion 34 extends downwards from the actuating shoulders 35, which form overall, an oval surface (FIG. 4) surrounding the central connecting piece 13 and extend downwards to provide a reinforcing edge 36.

As can be seen in FIG. 3, the spokes 29 have lateral reinforcements and are stiffened in the axial direction by stiffening ribs 31. The outer surface of the actuating sleeve 35 has an external handle in the form of a knurling.

FIG. 4 shows walls 44, which project downwards in the interior of the base portion 34. They form three arcuate portions 49 and extend in each case on either side to the circumference of the base portion in the outwards direction, so that they are formed between them slots 43. Between their walls 44 are small plates or webs 40, which form a second pressure point protector 39 for a second stroke and are connected to the walls by material bridges 41. One of the walls 44 is lengthened and forms a turning stop 38, against which the spokes 29 strike on turning.

During the manufacture of the discharge device the parts are assembled in the position shown in FIG. 1. The medium container 20 filled with the medium 24 is received in the actuating sleeve 25 and its pump chamber 23 is tightly sealed by the pump stopper 21. It is spaced from the tip of the plunger 17, when the actuating sleeve is in the starting position, which is defined by the fact that the ring 28 of the first pressure point protector 27 has locked in the snap-action device 32 and engages on the underside of the ribs 48.

The resulting ready-to-use discharge device is gripped by the user when needed, in that he places two fingers on the actuating shoulders 35 and presses with the thumb on the actuating surface 26. When an adequate actuating pressure is applied the material bridges 30 tear. These bridges form a predetermined breaking point, so that now the actuating sleeve moves upwards with a predetermined force and a correspondingly high actuating speed (cf. FIG. 1). After clearing the idle path predetermined by the distance between needle 17 and diaphragm 22, the needle perforates the diaphragm, the piston rod 16 presses the piston stopper into the medium container 20 and the medium 24 is released via the discharge channel 19 into the needle and the discharge opening 14 in the form of a spray mist. This takes place during the introduction by the patient of the connecting piece 13 into one of his nostrils.

At the end of this first discharge stroke step, in which in precisely dimensioned manner, half of the medium has been discharged, the spokes 29 strike against the stop 37 on the underside of the walls 44 and consequently limit the discharge. The discharge pressure suddenly collapses and atomization ends without dripping.

The patient can now introduce the connecting piece 13 into his second nostril, after preparing the discharge device for the second discharge stroke step. This takes place in that the actuating sleeve 25 is rotated by approximately 30° using the handle 33 (knurling). A comparison of FIGS. 3 and 4 makes it clear that the spokes 29 are under a roughly 30° distance from the slots 43 in walls 44. At the end of the first discharge stroke step they struck against the same roughly in the center of the portions 49. They are now turned to such an extent that they are located above the slots 43. The downwardly extended wall portion forms the turning s top 38.

If now the actuating sleeve 25 in FIG. 1 is pressed upwards again, then the spokes 29 engage on webs 40. On reaching the predetermined actuating pressure for the second discharge stroke step, the material webs 41 also break away there. The second discharge stroke step is performed in the same way as the first, in that the lower terminal edge of the piston rod 16 presses the pist on stopper 21 further into the medium container 20 and therefore delivers the medium in the manner of a thrust piston pump through the discharge channel 19.

In the represented embodiment the operation is thereby ended. It is consequently a double-stroke disposable pump, which is disposed of after a single use. Since with the exception of the medium reservoir 20 and the steel needle 17, as well as optionally the piston stopper 21, all parts are plastic injection moldings, namely preferably from the same material, recycling is possible.

The discharge device makes it possible to deliver the individual partial charges with high dosing precision and reliability and if desired in different quantities. Due to the idle paths to be traversed during the initial actuation, the partial strokes differ, which is taken into account in the design. It is possible to adapt the discharge device for other applications, e.g. medicaments intended for the eyes or other application points occurring in pairs or in multiple form. Also for several successive applications in spray or other delivery form, e.g. treatment in intervals of a few minutes to the same application point, it is still possible to use the present device.

With the exception of the differences explained hereinafter discharge device 11 in FIGS. 6 and 7 corresponds to that of FIGS. 1 to 5. Reference is made to the description of the latter and the same parts carry the same reference numerals.

The connecting piece 13 tapers towards its end and passes into a delivery tubule 50, which is constructed in one piece therewith and which is elongated and thin. Its diameter is between 3 and 4 mm or less, but generally no more than 5 mm and has a length over 10 mm, preferably between 20 and 30 mm. The tubule length to diameter ratio is approximately 7 and is advantageously above 5. It is circular and cylindrical and has at its end the delivery port 15 in the form of a spray nozzle. It is a small diameter hole shaped into the delivery tubule 50 and which together with the vortex channels 51 shaped into the front end of a filler 52, forms a nozzle with a conical spray jet.

The filler 52 is constructed in one piece with the piston rod 16 and has on its outside very small cross-section line channels 53 in the form of shaped in longitudinal grooves. The longitudinal piece fills an inner channel 54 of the hollow delivery tubule 50, which minimizes the dead space for the medium flowing out. The line channels 53 are connected to the inner bore of the needle 17 by a diameter reduction of the distributing chamber 53 formed by the filler/piston rod unit.

In FIG. 7 the delivery tubule is flexible and pliable, namely in the area of the hinge-like kink 56, which is in a central area of the tubule. It is formed in that in the vicinity of the kink the diameter of the filler 52*a* is reduced to such an extent that it is readily pliable due to the flexibility of its material. The delivery tubule material is also flexible to such an extent that it permits a certain hose-like bending. It would also be possible to shape bellows-like folds in there in order to facilitate bending. It is also possible to make the complete delivery tubule elastically or plastically pliable by a corresponding choice of material. It is also possible to permanently curve or bend the delivery tubule or to have a non-axial spray nozzle orientation.

For applying a medicament to the nasal cavity and the lateral channels thereof, particularly to the conchae nasi, the delivery tubule is introduced and correspondingly oriented by the doctor or some other trained person. The discharge device is then actuated in the aforementioned manner in order to perform a first stroke portion. Then the delivery tubule is introduced into the second nostril and the second stroke portion is initiated, optionally following the unlocking thereof.

In the case of a fixed-bent delivery tubule, in the case of a corresponding design of the finger application shoulders 35 a specific hand position can be prescribed, so that the doctor automatically encounters the correct point and this also applies for an eccentric nozzle arrangement. With a plastically deformable delivery tubule the doctor can orient the tubule in accordance with his experience, while with an elastically pliable tubule the latter can be appropriately shaped on introduction into the nose. It can be advantageous to apply a lubricant to the delivery tubule.

As a result of this specific form of the discharge device with delivery tubule, a very efficient application can take place to specific areas of the nasal mucosus or to specific nose areas and cavities, nasal application taking place in two successive strokes.

What is claimed is:

1. Discharge device for discharging a flowable medium (24) comprising:

a housing having a first housing part (12) and a second housing part (25);

a pump piston (21) disposed in at least one of the first housing part (12) and the second housing part (25) and moved in response to movement of at least one of the first housing part (12) and the second housing part (25);

a medium reservoir (20) for containing the medium (24), said medium reservoir (20) also forming a pump chamber (23), said pump piston (21) being moveable to produce pressure in the pump chamber (23);

a discharge channel (19) leading from the pump chamber (23) to a discharge opening (14) to allow release of the medium (24) when the pump piston (21) is moved to produce pressure in the pump chamber (23);

at least one intermediate stop (37) disposed between a starting position and a subsequent position of the second housing part (25), said intermediate stop being non-destructible in response to a first discharge stroke and separating said first discharge stroke from a second discharge stroke to prevent complete emptying of said medium reservoir (20) in a single motion;

at least two pressure release points (27) restricting operation of the second housing part (25) until a minimum actuating force is applied to overcome the pressure release points (27) and allow movement of the second housing part (25) through a first discharge stroke; and wherein the second housing part (25) is operable for moving the pump piston (21) in a first direction through a first discharge stroke from a starting position to the non-destructible intermediate stop (37) and through a second discharge stroke from the non-destructible intermediate stop (37) to the subsequent position to discharge successive partial charges of said medium.

2. Discharge device according to claim 1, wherein the pressure release points (27) comprise at least one breaking element (30), which is predetermined to be broken on actuation of the pump.

3. Discharge device according to claim 1, wherein one of the pressure release points (27) includes a shaping ring (28).

4. Discharge device according to claim 3, wherein the snap-in ring (28) is cast via frangible material bridges (30, 41) in one piece with a sleeve (25) receiving the medium container (20) and forming the second housing part (25).

5. Discharge device according to claim 1, wherein at least one of the pressure release points is located in the vicinity of a slot (43) bounded by walls (44) of the housing.

6. Discharge device according to claim 1, wherein the first housing part (12) has a projecting discharge portion (13) with the discharge opening (14) at its end, actuating shoulders (35) projecting laterally therefrom and a substantially cylindrical base portion (34) which, together with the connecting piece (13), receives the medium reservoir (20) and pressure release points (27, 39) and which projects out of the second housing part (25), which can be pressed into the first housing part (12).

7. Discharge device according to claim 1, wherein the medium reservoir (20) is tightly sealed in its starting position, but connected at the start of a further discharge stroke to the discharge channel (19), the discharge device (11) being constructed as a disposable multiple atomizer for successive administration of a medicament to a patient.

8. Discharge device according to claim 1, wherein for actuation of the thrust piston pump (46) a piston rod (16) presses into the medium reservoir (20) a piston stopper (21) forming a closure the medium reservoir (20), wherein said piston stopper (21) is perforatable by a hollow plunger (17), such as a hypodermic needle, for opening the medium reservoir (20) for connection to the discharge channel (19).

9. Discharge device according to claim 1, wherein a non-dispensing, idling path is provided between the starting position and a position in which the medium reservoir (20) is opened.

10. Discharge device according to claim 1, wherein the discharge opening is a spray nozzle.

11. Discharge device according to claim 1, wherein the first housing part (12) and the second housing part (25) are moveable relative to each other.

12. Discharge device for discharging a flowable medium comprising:

a housing having a first housing part (12) and a second housing part (25);

a pump piston (21) disposed in at least one of the first housing part (12) and the second housing part (25) and moved in response to movement of at least one of the first housing part (12) and the second housing part (25);

a medium reservoir (20) for containing the medium (24), said medium reservoir (20) also forming a pump chamber (23), said pump piston (21) being moveable to produce pressure in the pump chamber (23);

a discharge channel (19) leading from the pump chamber (23) to a discharge opening (14) to allow release of the medium (24) when the pump piston (21) is moved to produce pressure in the pump chamber (23);

at least one intermediate stop (37) disposed between a starting position and a subsequent position of the second housing part (25) to prevent complete emptying of said medium reservoir (20) in a single motion;

at least two pressure release points (30) holding the second housing part (25) stationary until a minimum actuating force is applied to allow movement of the second housing part (25) through a first discharge stroke; and wherein the second housing part (25) is operable for moving the pump piston (21) in a first direction through the first discharge stroke from a starting position to the intermediate stop (37) and through a second discharge stroke from the intermediate stop (37) to a subsequent position to discharge successive partial charges of said medium; and wherein the second housing part (25) is movable in a second direction relative to the first discharge stroke for generating a releasing action relative to the intermediate stop (37) and allowing the second discharge stroke.

13. Discharge device according to claim 12, wherein the intermediate stop (37) is abutted by spokes (29) connecting two portions (25, 28) of one of the housing parts (12, 25).

14. Discharge device according to claim 13, wherein the spokes (29) are reinforced on one side in a downward direction by an integrally formed rib.

15. Discharge device according to claim 12, wherein a turning stop (38) is provided for the releasing actuation.

16. Discharge device according to claim 15, wherein the intermediate stop (37) is formed by a projecting wall (44) of the housing (12).

17. Discharge device according to claim 12, further comprising a handle (33) for the releasing actuation.

18. Discharge device according to claim 12, wherein the discharge opening is a spray nozzle.

19. Discharge device according to claim 12, wherein the first housing part (12) and the second housing part (25) are moveable relative to each other.

20. Discharge device according to claim 19, wherein the second housing part (25) carries projections (29) which abut the intermediate stop (37) and wherein the intermediate stop (37) is formed as a housing part that also provides passages for receiving the projections (29) when the second housing part (25) is rotated.

21. Discharge device according to claim 20, wherein the second housing part (25) includes a sleeve that is moved in a rotational direction relative to the first direction to provide the release of the second housing part (25) from the intermediate stop (37).

22. Discharge device according to claim 12, wherein the second direction is a rotational direction relative to the first direction of the second housing part (25).

23. Discharge device according to claim 12, wherein the intermediate stop is defined by two stop elements, one of said two stop elements being provided on spokes (29) carrying a ring (28) and the other of said two stop elements (37) being formed on a bottom of a part (44) of the housing (12).

24. Discharge device according to claim 12, wherein the housing (12) has a projecting discharge portion (13) with the discharge opening (14) at its end, actuating shoulders (35) projecting laterally therefrom and a substantially cylindrical base portion (34) which, together with the connecting piece (13), receives the medium container (20) and pressure release points (27) and which projects out of the actuating sleeve (25) which can be pressed into the housing (12).

25. Discharge device according claim 12, wherein the medium container (20) is tightly sealed in its starting position, but is connected at the start of the first discharge stroke to the discharge channel (19), the discharge device (11) being constructed as a disposable multiple atomizer for successive administration of a medicament to a patient.

26. Discharge device according claim 12, wherein the housing (12) includes a stop element (44) forming the intermediate stop (37), the stop element (44) having a slot (43) and a wall portion, and wherein the second housing part (25) is rotatable relative to the housing (12) and carries a second stop element (29) which is adjusted in relation with the slot (43) in order to allow the second stroke, the wall portion providing a turning stop for rotation of the second housing part (25).

27. Discharge device according to claim 12, wherein the pressure release points (27) comprise at least one breaking element (30), which is predetermined to be broken on actuation of the pump.

28. Discharge device for flowable media comprising:

a housing having a first housing part (12) and a second housing part (25);

a thrust piston pump (46);

a medium reservoir (20);

a pump chamber (23) of the thrust piston pump (46) being formed by the medium reservoir (20);

a discharge channel (19) leading from the pump chamber (23) to a discharge opening (14);

a pump piston (21) being movable in the pump chamber (23) over at least two partial discharge strokes from a starting position to at least one intermediate stop position and finally to a subsequent stop position in order to provide discharge successive partial discharges of said medium;

at least one intermediate stop (37) locking the thrust piston pump (46) in the intermediate stop position; and unlocking means for unlocking the thrust piston pump (46) from the intermediate stop for a second one of the two partial discharge strokes in response to an unlocking action, the unlocking action being a rotating action;

at least two destructible pressure points (27) providing for a minimum actuating force to be applied to the pump before the piston moves, wherein the first housing part (12) and the second housing part (25) are moveable relative to each other; and wherein the intermediate stop and the unlocking means are provided on said first housing part (12) and said second housing part (25).

* * * * *

UNITED STATES PATENT AND TRADEMARK OFFICE

CERTIFICATE OF CORRECTION

PATENT NO. : 6,321,942 B1
DATED : November 27, 2001
INVENTOR(S) : Krampen et al.

It is certified that error appears in the above-identified patent and that said Letters Patent is hereby corrected as shown below:

Column 3,
Line 13, “5mm.” should be -- 5mm --.

Column 4,
Line 30, “b e” should be -- be --.

Column 5,
Line 52, “pist on stopper” should be -- piston stopper --.

Column 7,
Line 45, “shaping ring” should be -- snap-in ring --.

Signed and Sealed this

Tenth Day of December, 2002

JAMES E. ROGAN
*Director of the United States Patent and Trademark Office*